US005876908A

United States Patent [19]

Gao et al.

[11] Patent Number: 5,876,908

[45] Date of Patent: Mar. 2, 1999

[54] PHOTOGRAPHIC ELEMENT CONTAINING IMPROVED INTERLAYER

[75] Inventors: Justin Z. Gao, Rochester; Andy H. Tsou, Pittsford; Charles C. Anderson, Penfield, all of N.Y.

[73] Assignee: Eastman Kodak Company, Rochester, N.Y.

[21] Appl. No.: 52,611

[22] Filed: Mar. 31, 1998

Related U.S. Application Data

[63] Continuation-in-part of Ser. No. 841,439, Apr. 22, 1997, abandoned.

[51] Int. Cl.[6] ..... G03C 1/76; G03C 11/06

[52] U.S. Cl. ..... 430/496; 430/523; 430/537; 430/539; 430/950; 430/961

[58] Field of Search ..... 430/537, 539, 430/950, 961, 523, 496

[56] References Cited

U.S. PATENT DOCUMENTS

| | | | |
|---|---|---|---|
| 4,499,179 | 2/1985 | Ota et al. | 430/961 |
| 4,508,818 | 4/1985 | Ogawa et al. | 430/961 |
| 4,777,113 | 10/1988 | Inoue et al. | 430/537 |
| 4,822,727 | 4/1989 | Ishigaki et al. | 430/961 |
| 5,066,572 | 11/1991 | O'Connor et al. | 430/961 |
| 5,300,417 | 4/1994 | Lushington et al. | 430/961 |
| 5,310,639 | 5/1994 | Lushington et al. | 430/961 |

FOREIGN PATENT DOCUMENTS

| | | |
|---|---|---|
| 490302 | 6/1992 | European Pat. Off. . |
| 646836 | 4/1995 | European Pat. Off. . |

OTHER PUBLICATIONS

T. Mura, "Micromechanics of Defects in Solids" 2nd Re. Ed., Martinus Nijhoff Publishers, Dordrecht, Boston pp. 364–380 1986.

Tandon et al., "Average Stress . . . Composites", *Composite Science and Tech.*, vol. 27, 1986, pp. 111–132, 1986.

*Primary Examiner*—Richard L. Schilling
*Attorney, Agent, or Firm*—Carl F. Ruoff

[57] ABSTRACT

The present invention is an imaging element including a support having a front side and a back side, at least one backing layer on the back side of the support, at least one silver halide emulsion layer superposed on the front side of the support, an interlayer superposed on the silver halide emulsion layer having a thickness of between 0.2 μm and 1.2 μm and a stiffness ratio of the interlayer to the silver halide emulsion layer of from 2 to 15; and a protective overcoat layer superposed on the interlayer having a thickness of from 0.3 to 2 μm. The ratio of the thickness of the interlayer to the protective overcoat layer is less than or equal to 1.

11 Claims, 3 Drawing Sheets

PHOTOGRAPHIC ELEMENT CONTAINING IMPROVED INTERLAYER

CROSS-REFERENCE TO RELATED APPLICATIONS

This is a continuation-in-part application of Ser. No. 08/841,439, filed Apr. 22, 1997, now abandoned, entitled "Photographic Element Containing Improved Interlayer" by Gao et al.

FIELD OF THE INVENTION

This invention relates to photographic imaging elements comprising a support material, an image-forming layer, a protective overcoat containing matte beads, and an interlayer interposed between the protective overcoat and the image-forming layer. More specifically, this invention relates to an improved interlayer having specific physical properties that prevent the matte beads contained in the protective overcoat from penetrating into the imaging layer under severe temperature, pressure, and humidity storage conditions, thus reducing pressure sensitization of the imaging layers and front-to-back contact ferrotyping, sticking, and material contamination.

BACKGROUND OF THE INVENTION

During manufacturing, transport, storage, and use of a multilayer photographic film in a roll form, the front (i.e., the imaging side) of the photographic film comes into contact with the film backing. Depending on the severity of this contact, it can lead to ferrotyping, sticking and materials transfer. Ferrotyping refers to the imprinting of a glossy surface onto the front side of a photographic film following intimate contact with the backing. Depending on the composition of the backing, materials transfer that occurs during this intimate contact may have deleterious effects on the sensitometric behavior of the photographic film. To help prevent intimate contact between the front and back sides of a multilayer photographic film, the protective overcoat layer that overlies the imaging layer typically employs matte beads as spacers. These matte beads are hard, inorganic or organic particles such as silica particles or high Tg polymeric beads.

Front-to-back contact may still occur for a multilayer photographic product that contains matte beads in its outermost protective layer, especially for gelatin-based photographic layers exposed to high humidity. We have found that this failure of the matte beads to prevent front-to-back contact arises as a result of penetration of the matte beads into the photographic layers under pressure, for example, when the film is tightly wound into a roll. Although photographic layers may be harder than a matte bead, these photographic layer become softer with time due to their viscoelastic nature. The softening process is further accelerated at higher humidities by the plasticizing effects of moisture. Because of this matte bead penetration, the surface roughness of the photographic product is reduced resulting in the appearance of ferrotyping. Matte penetration can further lead to the dislocation of the silver grains for silver halide-containing photographic layers by contact stresses. The dislocation of the silver grains causes a pressure marking of the photographic product.

Up to now, the mechanisms that cause and the problems associated with matte bead penetration into imaging layers as a result of front-to-back contact have not been fully understood. In addition, the prior art does not discuss methods to prevent such matte bead penetration into photographic layers. To avoid pressure sensitization, the prior art describes adding a soft cushion layer as a stress absorbing intermediate layer between the protective overcoat and photographic layers as disclosed in U.S. Pat. Nos. 5,066,572, 5,300,417, and 5,310,639. However, these soft cushion layers can not reduce matte bead penetration. In fact, such soft layers actually promote matte bead penetration.

U.S. Pat. No. 4,499,179 discloses using a two-layer protective overcoat for a photographic layer in an attempt to reduce pressure marking. The two-layer protective overcoat comprises an outer layer and an inner layer, wherein the ratio of the thickness of the inner layer to the outer layer is at least 1.5. The outer layer contains oil particles in the form of finely dispersed, water-insoluble droplets. The inner layer contains fine particles of an inorganic oxide or polymeric material, and optionally, oil particles analogous to those contained in the outer layer. Such a thick, inner protective layer containing hydrophobic fillers is undesirable since it may retard the image development process and may reduce image sharpness. In addition, since the inner protective layer may contain both oil droplets and fine particles of organic or inorganic material, such a layer may be quite soft due to the presence of the oil droplets and therefore be undesirable as a method to prevent matte bead penetration during front-to-back contact.

The prior art also describes in U.S. Pat. No. 4,822,727 the use of one or more overcoat layers containing polymer latexes having a Tg above 20° C. and polymer latexes having a Tg below 20° C. Such overcoat layers reportedly have reduced brittleness and reticulation while improving sticking resistance. However, by incorporating both the soft and hard latexes in the overcoat layers, the stiffness of these layers may be too low to prevent matte bead penetration during front-to-back contact.

The aforementioned prior art references relate to some aspects of the present invention, but, do not fully consider the problem of matte bead penetration into imaging layers during front-to-back contact, nor do they disclose or suggest an adequate solution to this problem. Therefore, there is a need for an imaging element having an improved interlayer that prevents matte bead penetration and the associated problems of pressure sensitization, ferrotyping, sticking, and materials transfer without compromising image development and image quality.

SUMMARY OF THE INVENTION

The present invention is an imaging element including a support having a front side and a back side, at least one backing layer on the back side of the support, at least one silver halide emulsion layer superposed on the front side of the support, an interlayer superposed on the silver halide emulsion layer having a thickness of between 0.2 $\mu$m and 1.2 $\mu$m and a stiffness ratio of the interlayer to the silver halide emulsion layer of from 2 to 15; and a protective overcoat layer superposed on the interlayer. The ratio of the thickness of the interlayer to the protective overcoat layer is less than or equal to 1.

BRIEF DESCRIPTION OF THE DRAWINGS

FIG. 1 illustrates a representative element in which there is only one matte bead. The top of the matte bead is in contact with the photographic element backing.

For a better understanding of the present invention, together with other and further capabilities thereof, reference is made to the following disclosure and claims in connection with the above described drawings.

DETAILED DESCRIPTION OF THE PREFERRED EMBODIMENT

The present invention is an imaging element comprising a support material, an image-forming layer, a protective overcoat containing matte beads, and an improved interlayer interposed between the protective overcoat and the image-forming layer. The interlayer of the invention has specific properties that helps prevent the matte beads contained in the protective layer from penetrating into the emulsion layer when the films are stored at high pressure, humidity, and temperature conditions thus reducing ferrotyping, front-to-back sticking, and pressure marking of the emulsion layer.

Figure 1:
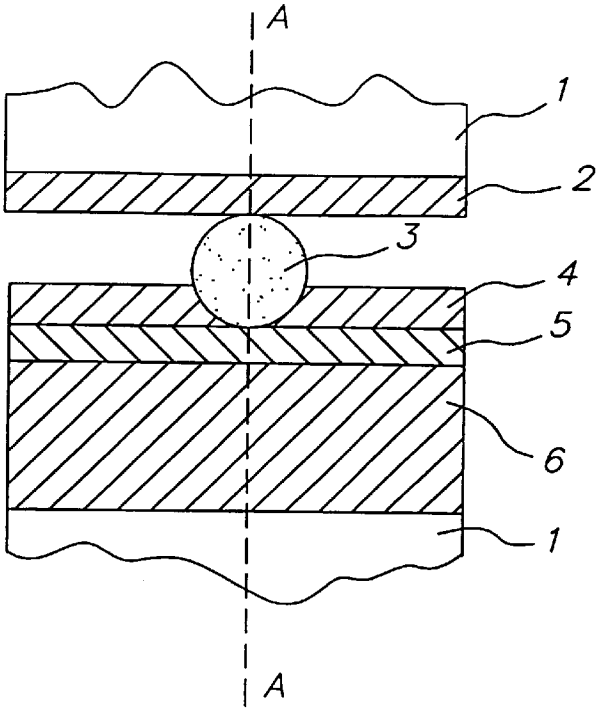
FIG. 1 is a schematic view of the present invention. The multilayer photographic element contains matte bead particle 3 contained in a protective layer 4, an interlayer 5, imaging layer 6, support 1 and backing 2.

Referring now to the drawing in FIG. 1 which illustrates a schematic view of the imaging element of the present invention. In a particularly preferred embodiment, the imaging elements of this invention are photographic elements, such as photographic films, photographic papers or photographic glass plates, in which the image-forming layer 6 is a radiation-sensitive silver halide emulsion layer. Such emulsion layers typically comprise a film-forming hydrophilic colloid. The most commonly used of these is gelatin which is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic emulsions of the present invention can be simple black-and-white or monochrome emulsions comprising a light-sensitive silver halide emulsion or they can be multilayer and/or multicolor emulsions.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominanty on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September 1994, and the references listed therein.

The photographic silver halide emulsions utilized in this invention can contain other addenda conventional in the photographic art Useful addenda are described, for example, in Research Disclosure, Item 36544, September 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

On the emulsion layer side of the support material a protective overcoat layer 4 serves as the outermost layer. The protective overcoat layer contains a hydrophilic colloid such as gelatin, wetting aid, organic or inorganic matte beads 3, lubricants such as silicone compounds, higher fatty acids and derivatives, paraffin or wax-like materials, or perfluoro- or fluoro-containing materials. The overcoat layers of the invention may also contain other addenda well known in the imaging art such as hardener, image stabilizers, filter dyes, dispersing aids, and the like. The thickness range for the protective overcoat is typically about 0.3 to 2 $\mu$m, preferably from 0.5 to 1.2 $\mu$m.

The matte beads 3 contained in the protective overcoat layer may be any of the matte materials well known in the art, such matting agents have been disclosed in Research Disclosure No. 308119, published December 1989, pages 1008 to 1009. The matte beads may be the so called permanent matte or soluble matte that is removed during film processing or a combination of both types. Typically the matte beads are incorporated into the overcoat layer at a dry coating weight of about 0.5 to 300 mg/m$^2$. The mean particle diameter for the matte beads is typically 0.2 to about 10 $\mu$m.

The interlayer 5 of the present invention prevents the penetration of matte beads into the underlying emulsion layer. To be effective at preventing matte bead penetration while not deleteriously effecting image development and image quality, the thickness and the stiffness of the interlayer must have values within a specific range. The thickness of the interlayer is between 0.2 $\mu$m and 1.2 $\mu$m, the ratio of the thickness of the interlayer to the protective overcoat layer is 1.0 or less, and the stiffness ratio of the interlayer to the emulsion is between 2 and 15. Too thin an interlayer would require that it be excessively stiff and too brittle to have good physical properties. Too thick an interlayer is undesirable for both image development and image sharpness. When the stiffness ratio of the interlayer to the emulsion layer is less than 2 the interlayer is not very effective in preventing matte bead penetration. Interlayers with a stiffness ratio greater than 15 may be too brittle and require large concentrations of filler materials to achieve these stiffness values, such high filler concentrations may impede the image development process.

For the purpose of the present invention, the interlayer comprises a hydrophilic colloid such as gelatin as the matrix material and the stiffness of the interlayer can be increased by adding a compatible polymer having a higher modulus or hard fillers such as inorganic oxide particles, examples of these include colloidal silica, titanium dioxide particles, alumina particles, mica, clays, conductive or nonconductive tin oxide particles, conductive metal antimonate particles, and the like or high Tg (i.e., glassy) polymer particles. The Tg of the particles is preferably 30° C. or greater. Due to the fact that the interlayer is very thin, when a filler is added to the interlayer the filler particles must have a very small particle size. The filler particle size range is 2 nm to 500 nm, preferably from 4 nm to 100 nm. The required concentration of the high modulus polymer or filler particles in the interlayer to achieve a stiffness ratio of the interlayer to the emulsion layer that is within the range of 2 to 15 can be determined from the theories that relate the mechanical properties of each polymer contained in a blend or the mechanical properties of fillers and the matrix material to the stiffness of the composite layer. Such theories have been well established in the literature (see e.g., Mura, T. "Micromechanics of Defects in Solids"; 2nd revised Edition, Martinus Nijhoff Publishers, Dordrecht, Boston; Tandon, G. P. and Weng, G. J; "Average Stress in Matrix and Effective Moduli of Randomly Oriented Composites"; Composite Science and Technology, Vol. 27, 1986, pp. 111–132). Such an analysis is performed routinely in the art of micromechanics of composite materials. In addition to the hydrophilic colloid and addenda such as a high modulus, compatible polymer or filler particles, the interlayer may also contain surfactants, dispersing aids, hardener, and filter dyes.

Typical support materials 1 for the purpose of the present invention comprise various polymeric films, papers, glass, and the like, but both acetate and polyester supports well known in the art are preferred. The thickness of the support is not critical. Support thickness of 2 to 10 mil (0.002 to 0.010 inches) can be used. The supports typically employ an undercoat or subbing layer well known in the art that comprises, for example, for polyester support a vinylidene chloride/methyl acrylate/itaconic acid terpolymer or vinylidene chloridelacrylonitrile/acrylic acid terpolymer. Further details regarding supports are contained in Research Disclosure, Item 36544, September 1994.

The imaging elements of the present invention also typically contain a backing 2 on the side of the support opposite to the imaging layer. The backing may comprise one or more layers depending on the use for which it is intended. For example, the backing layer may be a single-layer, abrasion resistant backing; a two-layer backing having an antistatic layer and an abrasion resistant overcoat or an antistatic layer and a magnetic recording layer overcoat; a three-layer backing having an antistatic layer, a magnetic recording layer, and an abrasion resistant overcoat; etc. The one or more layers in the backing may contain various addenda well known in the art such as wetting aids, crosslinking agents, matte beads, lubricants, etc.

EXAMPLES

Matte penetration and the disturbance to the emulsion layer due to pressure exerted by front-to-back contact, and the effectiveness of the interlayer to prevent such a disturbance are determined by finite element analysis. In accordance with conventional finite element analysis techniques, the first step is to generate a geometric representation of the entire photographic element including the matte bead and all layers. A geometric model of the photographic element is created by dividing the matte bead and photographic layers into discrete elements (also called mesh). Due to symmetry, only one half (right of the line of symmetry AA) of the photographic element is discretized, and an axisymmetric model is utilized. Symmetric boundary conditions are applied on the left and right edges. The ferrotyping process is simulated by imposing a one psi pressure on top of matte bead 3 shown in FIG. 1.

Figure 2:
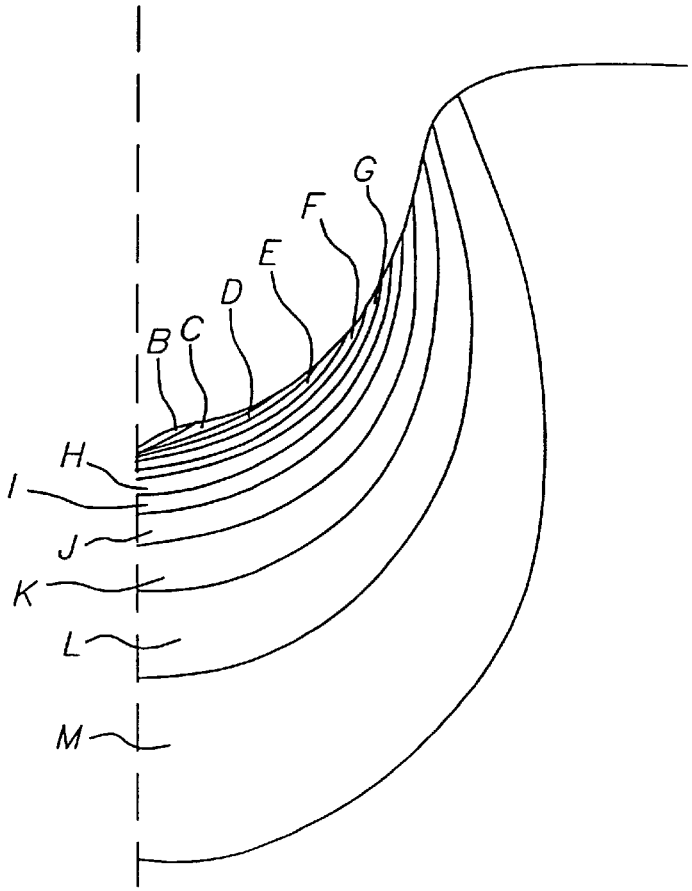
FIG. 2 illustrates the finite element analysis result for an imaging element that does not include an interlayer (this is the result for Comparative sample A in the examples).
Figure 3:
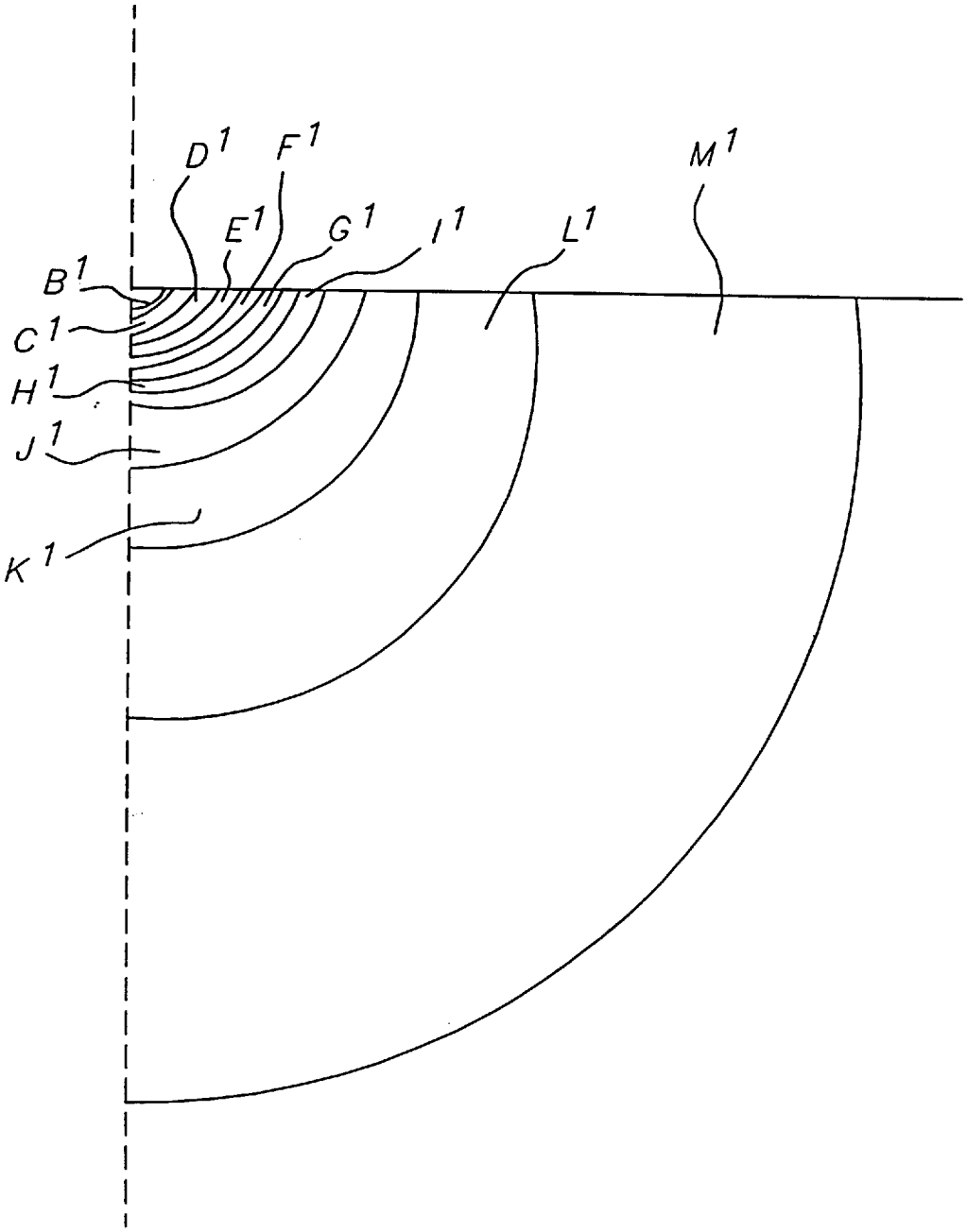
FIG. 3 illustrates the finite element analysis result for an imaging element of the invention (this is the result for Example 6).

Without the interlayer, significant disturbance to the emulsion occurs, especially near the line of symmetry AA, as seen from the finite element analysis, where vertical displacement in the emulsion near the matte bead is used to represent the disturbance. The maximum displacement is 1.85 $\mu$m which occurs in region B in FIG. 2. The displacement range in region B is 1.7 $\mu$m to 1.85 $\mu$m. The magnitude of the displacement reduces from region B to regions C, D, E, etc. The displacement ranges in regions C, D, E, F, G, H, I, J, K, L, M are, respectively, 1.55 $\mu$m to 1.70 $\mu$m, 1.41 $\mu$m to 1.55 $\mu$m, 1.26 $\mu$m to 1.41 $\mu$m, 1.12 $\mu$m to 1.26 $\mu$m, 0.981 $\mu$m to 1.26 $\mu$m, 0.836 $\mu$m to 0.981 $\mu$m, 0.692 $\mu$m to 0.836 $\mu$m, 0.548 $\mu$m to 0.692 $\mu$m, 0.404 $\mu$m to 0.548 $\mu$m, 0.260 $\mu$m to 0.404 $\mu$m and 0.115 $\mu$m to 0.260 $\mu$m. When the interlayer is introduced, the disturbance to the emulsion is greatly reduced. FIG. 3 shows the vertical displacement in the emulsion after a 1 $\mu$m interlayer, in which the ratio of the thickness of the interlayer to the overcoat layer is equal to 1.0, is utilized. The stiffness of the interlayer is 3.6 times that of the emulsion. The maximum displacement in FIG. 3 is 0.179 $\mu$m which occurs in region $B^1$. The displacement range in region $B^1$ is 0.166 $\mu$m to 0.179 $\mu$m. The magnitude of the displacement reduces from region $B^1$ to regions $C^1$, $D^1$, $E^1$, etc. The displacement ranges in regions $C^1$, $D^1$, $E^1$, $F^1$, $G^1$, $H^1$, $I^1$, $K^1$, $L^1$, $M^1$ are, respectively, 0.152 $\mu$m to 0.166 $\mu$m, 0.138 $\mu$m to 0.152 $\mu$m, 0.124 $\mu$m to 0.138 $\mu$m, 0.110 $\mu$m to 0.124 $\mu$m, 0.0965 $\mu$m to 0.110 $\mu$m, 0.0826 $\mu$m to 0.0965 $\mu$m, 0.0687 $\mu$m to 0.0826 $\mu$m, 0.0548 $\mu$m to 0.0687 $\mu$m, 0.0409 $\mu$m to 0.0548 $\mu$m, 0.0270 $\mu$m to 0.0409 $\mu$m and 0.0132 $\mu$m to 0.0270 $\mu$m. The relative maximum displacement reduction in emulsion, $\eta$, is computed from the values for the maximum displacement with no interlayer, $d_{ni}$, and the maximum displacement with an interlayer, $d_i$, using the following equation:

$$\eta = (d_{ni} - d_i)/d_{ni} \times 100\% \quad (1)$$

$$= \frac{1.85 - 0.179}{1.85} \times 100\% = 90.3\%$$

This indicates that a 90.3 percent reduction in maximum displacement in the emulsion is achieved by introducing an interlayer of 1 $\mu$m thickness and a stiffness 3.6 times as compared to that of the emulsion. In the above calculation, the Young's modulus of the support, backing, matte bead, protective layer and emulsion are 4826 MPa, 2618 MPa, 2618 MPa, 500 MPa and 500 MPa, respectively; their Poisson ratios are 0.35, 0.3, 0.3, 0.3 and 0.3, and their yield stresses are 96.53 MPa, 48.26 MPa, 48.26 MPa, 11.1 MPa and 11.1 MPa. These values of material properties are consistent with our experimental measurements at a relative humidity of 80% and a temperature of 70° F.

Figure 4:
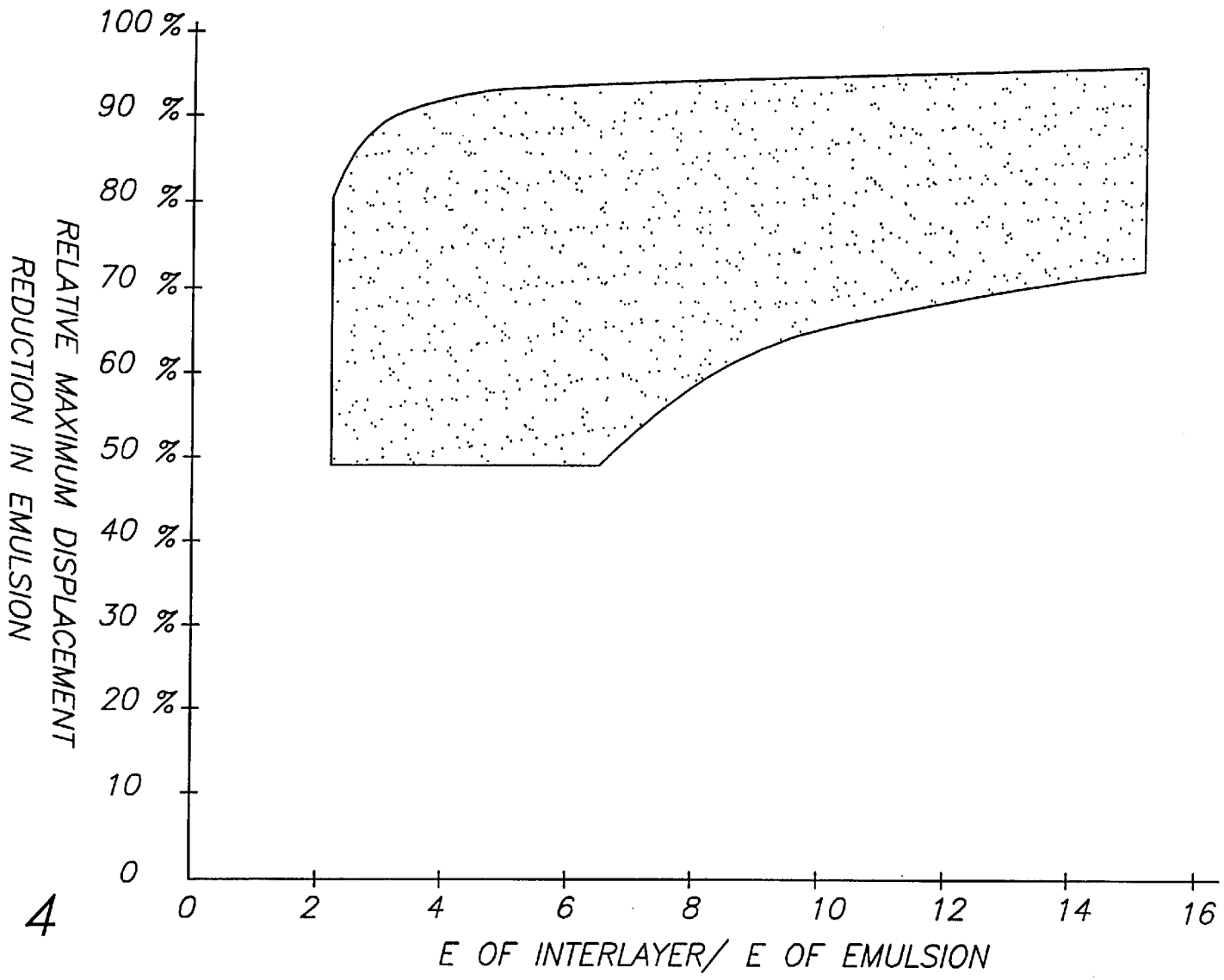
FIG. 4 is a graphical summary of the results for the effect of interlayer stiffness and thickness on the relative reduction in displacement of the emulsion layer due to penetration of the matte bead.

FIG. 4 defines the domain (the shaded area) within which a 50 percent or more reduction in maximum displacement, $\eta$, can be achieved. The horizontal axis is the ratio of the stiffness (Young's modulus) of the interlayer to that of the emulsion. The vertical axis is the relative maximum displacement reduction in the emulsion computed using Equation (1).

The comparative sample A in Table 1 is the prior art with no interlayer. The comparative sample B has an interlayer with a thickness and stiffness combination that produces a maximum displacement reduction of 15%, (i.e., less than the 50% reduction provided by the elements of the invention). Examples 1 to 6 represent photographic elements containing an interlayer of the invention and yield a maximum displacement reduction more than 50% in comparison to the comparative sample A. As shown in Table 1, the maximum displacement reduction increases nonlinearly with respect to the ratio of stiffness ($E_{interlayer}/E_{emulsion}$) for a fixed interlayer thickness. Unlike the prior art in which the thickness of the inner protective layer must be greater than the liquid droplet-containing outer protective layer, as described in U.S. Pat. No. 4,499,179, we have found that the interlayer of the present invention yields surprisingly significant reductions in matte bead penetration and displacement in the emulsion layer even when much thinner than the protective overcoat layer, thus reducing the potential impact of the interlayer on image processing and sharpness.

TABLE 1

| Example | Thickness of interlayer | Ratio of interlayer thickness to overcoat thickness | E inter/E emul* | Reduction, $\eta$** |
|---|---|---|---|---|
| Comparative sample A (no interlayer) | 0 | N/A | N/A | 0% |
| Comparative sample B | 0.1 $\mu$m | 0.1 | 2.2 | 15% |
| Example 1 | 0.3 $\mu$m | 0.3 | 5 | 59% |
| Example 2 | 0.3 $\mu$m | 0.3 | 10 | 75% |
| Example 3 | 0.5 $\mu$m | 0.5 | 3 | 57% |
| Example 4 | 0.5 $\mu$m | 0.5 | 9 | 86% |
| Example 5 | 1 $\mu$m | 1.0 | 3 | 84% |
| Example 6 | 1 $\mu$m | 1.0 | 3.6 | 90.3% |

*E_inter/E_emul = stiffness of interlayer/stiffness of emulsion
**$\eta$ is the maximum displacement reduction defined in Equation (1)

The invention has been described in detail with particular reference to certain preferred embodiments thereof, but it will be understood that variations and modifications can be effected within the spirit and scope of the invention.

What is claimed is:

1. An imaging element comprising:

a support having a front side and a back side;

at least one backing layer on the back side of said support;

at least one silver halide emulsion layer superposed on the front side of the support;

an interlayer superposed on said at least one silver halide emulsion layer having a thickness of between 0.2 $\mu$m and 1.2 $\mu$m and a stiffness ratio of said interlayer to said at least one silver halide emulsion layer of from 2 to 15; and a protective overcoat layer superposed on said interlayer having a thickness of from 0.3 to 2 $\mu$m wherein a ratio of the thickness of said interlayer to said protective overcoat layer is less than or equal to 1.

2. The imaging element of claim 1 wherein said support is selected from the group consisting of polymeric films, papers, and glass.

3. The imaging element of claim 1 wherein said support has a thickness of from 2 to 10 mil.

4. The imaging element of claim 1 further comprising a subbing layer interposed between said support and said at least one silver halide emulsion layer.

5. The imaging element of claim 1 wherein said protective overcoat layer comprises a hydrophilic colloid, a wetting aid, and organic or inorganic matte beads.

6. The imaging element of claim 5 wherein said protective overcoat further comprises lubricants, hardeners, image stabilizers, filter dyes, or dispersing aids.

7. The imaging element of claim 1 wherein said protective overcoat has a thickness of from 0.3 to 1.2 $\mu$m.

8. The imaging element of claim 1 wherein said interlayer comprises a hydrophilic colloid and a compatible polymer or hard fillers.

9. The imaging element of claim 8 wherein the hard fillers comprise inorganic oxide particles or polymer particles having a Tg of 30° C. or greater.

10. The imaging element of claim 8 wherein the hard fillers have a particle size of from 2 nm to 500 nm.

11. The imaging element of claim 1 wherein said interlayer further comprises surfactants, dispersing aids, hardeners, or filter dyes.

* * * * *